US008419081B2

(12) United States Patent
Zhang

(10) Patent No.: US 8,419,081 B2
(45) Date of Patent: Apr. 16, 2013

(54) SIDE-HUNG DOOR OR WINDOW SINGLE LATCH LOCK

(75) Inventor: Gongchun Zhang, Zengcheng (CN)

(73) Assignee: Cmech (Guangzhou) Industrial, Ltd. (CN)

( * ) Notice: Subject to any disclaimer, the term of this patent is extended or adjusted under 35 U.S.C. 154(b) by 329 days.

(21) Appl. No.: 12/778,250

(22) Filed: May 12, 2010

(65) Prior Publication Data

US 2011/0185777 A1 Aug. 4, 2011

(30) Foreign Application Priority Data

Feb. 4, 2010 (CN) ..... 2010 2 0112024 U

(51) Int. Cl.

| | |
|---|---|
| ***E05B 65/10*** | (2006.01) |
| ***E05B 3/00*** | (2006.01) |
| ***E05B 1/00*** | (2006.01) |
| ***E05B 13/00*** | (2006.01) |
| ***E05C 3/12*** | (2006.01) |

(52) U.S. Cl.

USPC ..... 292/92; 292/336.3; 292/347; 292/348; 292/DIG. 20; 292/DIG. 65; 292/358; 292/359; 292/219

(58) Field of Classification Search ..... 292/92, 292/335, 217, 219

See application file for complete search history.

(56) References Cited

U.S. PATENT DOCUMENTS

| | | | | |
|---|---|---|---|---|
| 1,383,974 | A * | 7/1921 | Bolles | 292/21 |
| 3,147,608 | A * | 9/1964 | Turner et al. | 70/468 |
| 3,494,650 | A * | 2/1970 | Slopa | 292/92 |
| 3,677,591 | A * | 7/1972 | Waldo | 292/221 |
| 4,632,439 | A * | 12/1986 | Miller | 292/166 |
| 4,635,977 | A * | 1/1987 | Yamada | 292/92 |
| 6,357,807 | B1 * | 3/2002 | Fan | 292/226 |
| 6,428,060 | B1 * | 8/2002 | Metz | 292/227 |
| 7,671,719 | B2 * | 3/2010 | Sogo | 340/5.73 |
| 7,717,480 | B2 * | 5/2010 | Fan | 292/1.5 |
| 7,748,758 | B2 * | 7/2010 | Fang et al. | 292/347 |
| 8,042,843 | B2 * | 10/2011 | Tien | 292/92 |
| 2006/0214436 | A1 * | 9/2006 | Wheatland et al. | 292/336.3 |

FOREIGN PATENT DOCUMENTS

CN 20081014969 4/2008

* cited by examiner

*Primary Examiner* — Thomas Beach
*Assistant Examiner* — Faria Ahmad
(74) *Attorney, Agent, or Firm* — Schmeiser, Olsen & Watts, LLP

(57) ABSTRACT

The present utility model discloses a side-hung door or window single latch lock, comprising: a first lock body and a second lock body disposed on an inner side and an outer side of a door or window and sandwiching the door or window in between, the first lock body including a first handle and the second lock body including a second handle, characterized in that the first lock body further comprises a latch assembly linked to the first handle and controlling opening and closing, and an elastic locking and controlling mechanism respectively linked to the first handle and the second handle to transmissively control the opening and closing of the latch assembly. As compared with the past, the present utility model is advantageous in that it is simple in overall structure, has less transmission components, is convenient and quick in assembling and simple and easy to operate, adapted for anti-theft needs of left side-hung or right side-hung door or window, exhibits a good applicability and strong universality, and is relatively low in cost and adapted for spread for use.

10 Claims, 4 Drawing Sheets

SIDE-HUNG DOOR OR WINDOW SINGLE LATCH LOCK

TECHNICAL FIELD

The present utility model relates to a door or window lock in the art of door or window anti-theft apparatuses, particularly to a side-hung door or window single latch lock.

BACKGROUND ART

In the prior art, there are various patterns of door or window locks with different efficacies. Conventional insertion-core lock bodies and ball-shaped lock bodies are structurally simpler and on the lower side in cost and price, but they have the following drawbacks: when they are mounted, the door body structure must be destroyed: a groove must be opened in one of the longitudinal sides of the door body to receive the lock body itself and allow for extension and retraction of the latch; the mounting procedure is troublesome and time-consuming and the strength of the door body is also destroyed. The current side-hung door or window locks do not require destroy of the door body structure and the mounting procedure is comparatively simpler, but such locks are structurally complicated, include too many transmission parts and are disadvantageous in inconvenient operations and high costs. Therefore, the scope of use of such locks is limited to a great extent.

SUMMARY OF THE UTILITY MODEL

An object of the present utility model is to provide a side-hung door or window single latch lock which is simple in structure, convenient to assemble, easy to operate and is low in cost, to overcome the shortcomings and drawbacks of the prior art.

To achieve the above object, the present utility model employs the following technical solutions:

A side-hung door and window single latch lock comprises a first lock body and a second lock body disposed on an inner side and an outer side of a door or window and sandwiching the door or window in between, wherein the first lock body comprises a first handle and the second lock body comprises a second handle; the first lock body further comprises a latch assembly linked to the first handle and controlling opening and closing, and an elastic locking and controlling mechanism respectively linked to the first handle and the second handle to transmissively control the opening and closing of the latch assembly.

Furthermore, the latch assembly comprises: a latch which is rotatably and telescopically mounted in the first lock body and which ramp end portion extends out of the first lock body and which opposite end portion is rotatably coupled to a latch mounting base in an internal cavity of the first lock body; a first return spring disposed at a proximal end of a rotating and connecting position of the latch, with both ends thereof respectively abutting against the internal cavity of the first lock body and the latch to ensure the latch to tend to extend outwardly.

Furthermore, the first handle is rotatably mounted on a side of the first lock body opposite to the latch, wherein a hand controlled end portion of the first handle extends out of the first lock body, an opposite end portion thereof is provided with a link, and the link is rotatably connected to a first handle mounting base of the internal cavity of the first lock body and linked to the latch at an outer end thereof.

Furthermore, the elastic locking and controlling mechanism comprises: an elastic clutch-type lock core including a first clutch piece and a second clutch piece converting shaft rotation into an axial translation and cooperating in use. The elastic locking and controlling mechanism comprises: an elastic clutch-type lock core telescopically encapsulated in the first lock body, an inside telescopic end portion thereof abutting against and cooperating with the link of the first handle; a connecting shaft which both end portions are respectively linked to an outside telescopic end portion of the elastic clutch-type lock core and the second handle.

Preferably, the elastic clutch-type lock core comprises: a first clutch piece movably embedded in a main body of the elastic clutch-type lock core, with one end portion thereof extending out of the elastic clutch-type lock core main body and linked to the connecting shaft, an opposite end thereof being provided with a "V"-shaped slot, and the slot consists of a first face and a second face, the first face and the second face have an angle; a second clutch piece movably embedded in the elastic clutch-type lock core main body, with one end portion thereof extending out of the elastic clutch-type lock core main body and abutting against and cooperating with the link, an opposite end thereof being provided with a "Λ"-shaped boss mating with the "V"-shaped slot; a second return spring which is movably provided around the second clutch piece and which both ends respectively abut against and cooperating with an internal chamber of the elastic clutch-type lock core main body and the "Λ"-shaped boss of the second clutch piece.

Furthermore, the first lock body is provided with a double lock switch for locking the latch at one end of the first handle, the double lock switch comprising: a double lock control block movably disposed outside of the first lock body, and the double lock control block comprises a base and a lug locates on the centre of the base, and the lug is perpendicular to the base having a "⊥" cross-sectional configuration; a double lock limiting piece moveably disposed inside the first lock body and linked to the double lock control block; a positioning elastic tab disposed outside the first lock body and provided around the double lock limiting piece, and the positioning elastic tab is a rectangle tab and having a square hole. Preferably, an arcuate protrusion is provided on each of both opposite ends of the positioning elastic tab, an arcute recess is provided at a position of the first lock body corresponding to the positioning elastic tab to mate with the arcuate protrusion.

Furthermore, on one side of the "Λ"-shaped boss of the second clutch piece is provided a limiting pin extending out of the elastic clutch-type lock core main body and engaging and disengaging the double lock limiting piece to interfere the action of the elastic locking and controlling mechanism; on the other end of the "Λ"-shaped boss of the second clutch piece is provided a fixed pin extending out of the elastic clutch-type lock core main body and combining the limiting pin to ensure a sliding direction of the second clutch piece. On both opposite sides of the elastic clutch-type lock core main body are respectively provided an elongated guide groove for allowing the limiting pin and fixed pin to slide reciprocatingly.

As compared with the prior art, the present utility model is advantageous in that it is simple in overall structure, has less transmission components, is convenient and quick in assembling and simple and easy to operate, adapted for anti-theft needs of left side-hung or right side-hung door or window, exhibits a good applicability and strong universality, and is relatively low in cost and adapted for spread for use.

The specific implementation modes of the present utility model is described with reference to the following accompanying drawings to make the present utility model more clearly understood.

BRIEF DESCRIPTION OF THE ACCOMPANYING DRAWINGS

FIGS. 1*a* and 1*b* are schematic views of a first embodiment of the present utility model;

DETAILED DESCRIPTION OF PREFERRED EMBODIMENT

Embodiment 1

Figure 1A:
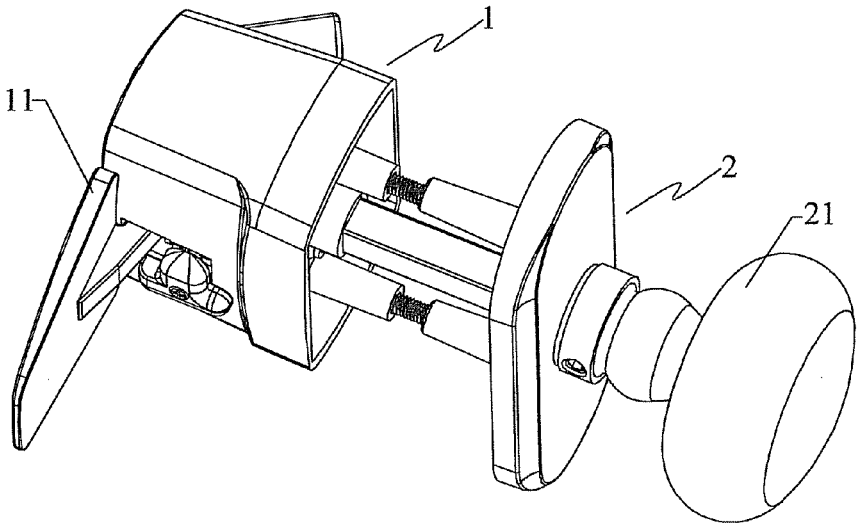
Figure 1B:
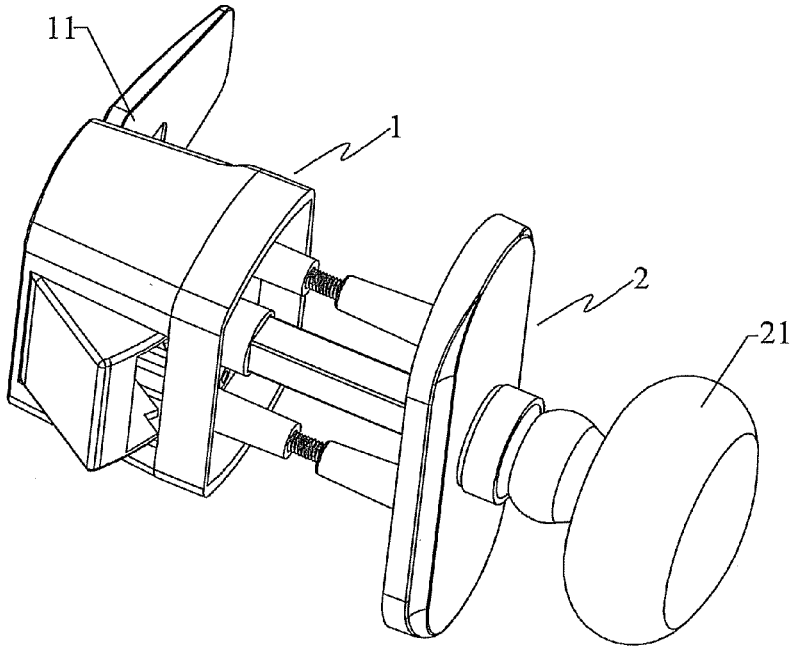

As shown in FIGS. 1*a* and 1*b*, the side-hung door and window single latch lock according to the present utility model comprises a first lock body 1 and a second lock body 2 disposed on an inner side and an outer side of a door or window and sandwiching the door or window in between, wherein the first lock body 1 is disposed on the inner side of the door or window and comprises a first handle 11, and wherein the second lock body 2 is disposed on the outer side of the door or window and comprises a second handle 21.

Figure 2:
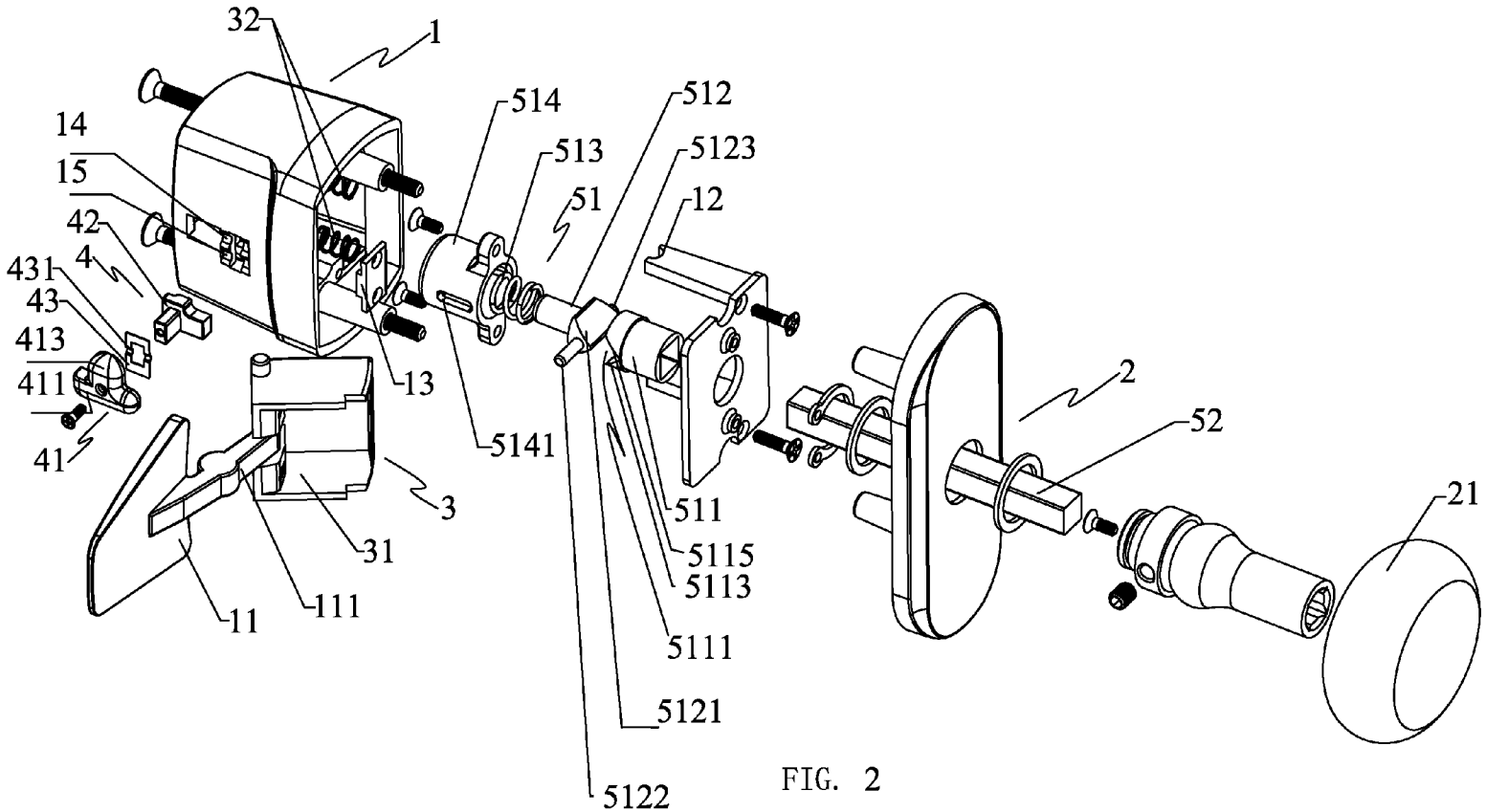
FIG. 2 is an exploded view of FIG. 1.
Figure 3:
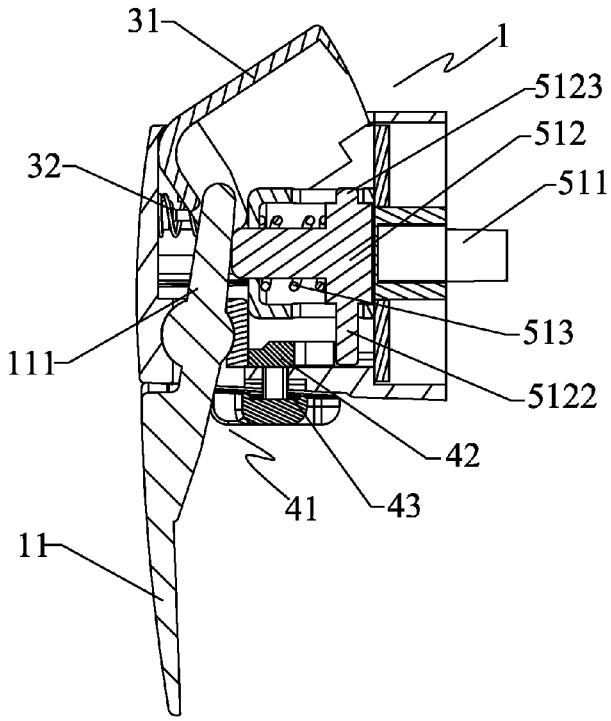
FIG. 3 is a cross sectional view of a first lock body in FIG. 1.
Figure 4:
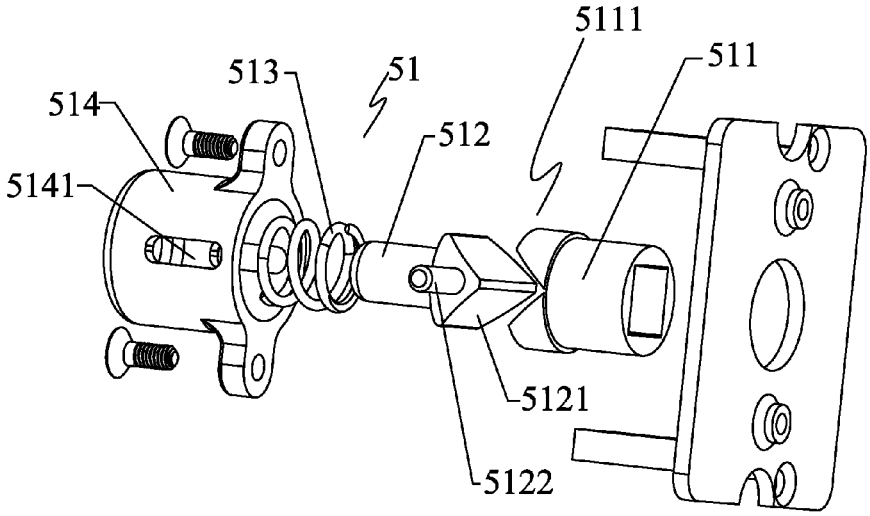
FIG. 4 is an exploded view of an elastic clutch-type lock core in FIG. 2.

As shown in FIGS. 2-4, the first lock body 1 further comprises a latch assembly 3 linked to the first handle 11 and controlling opening and closing, an double lock switch 4 for locking the latch, and an elastic locking and controlling mechanism 5 respectively linked to the first handle 11 and the second handle 21 to transmissively control the opening and closing of the latch assembly 3.

The latch assembly 3 comprises: a latch 31 which is rotatably and telescopically mounted in the first lock body 1 and which ramp end portion extends out of the first lock body 1 and which opposite end portion is rotatably coupled to a latch mounting base 12 in an internal cavity of the first lock body 1; a first return spring 32 disposed at a proximal end of a rotating and connecting position of the latch 31, with both ends thereof respectively abutting against the internal cavity of the first lock body 1 and the latch 31 to ensure the latch 31 to tend to extend outwardly. Furthermore, the first handle 11 is rotatably mounted on a side of the first lock body 1 opposite to the latch 31, wherein a hand controlled end portion of the first handle 11 extends out of the first lock body 1, an opposite end portion of the first handle 11 is provided with a link 111, and the link 11 is rotatably connected to a first handle mounting base 13 of the internal cavity of the first lock body 1 and linked to the latch 31 at an outer end thereof.

The double lock switch 4 comprises: a double lock control block 41 movably disposed outside of the first lock body 1 and includes a base 411 and a lug 413 locates on the centre of the base 411, and the lug 413 is perpendicular to the base 411; a double lock limiting piece 42 moveably disposed inside the first lock body 1 and linked to the double lock control block 41; a positioning elastic tab 43 disposed outside the first lock body 1 and provided around the double lock limiting piece 42, and the positioning elastic tab is a rectangle tab and having a square hole. Preferably, an arcuate protrusion 431 is provided on each of both opposite ends of the positioning elastic tab 43, a first arcute recess 14 and a second arcute recess 15 is provided at a position of the first lock body 1 corresponding to the positioning elastic tab 43 to mate with the arcuate protrusion 431. When the double lock control block of the double lock switch is pushed up, the arcuate protrusion 431 mate with the first arcute recess 14, the latch is locked and cannot retract; and when the double lock control block of the double lock switch is pushed down, the arcuate protrusion 431 mate with the second arcute recess 15, the latch can retract.

The elastic locking and controlling mechanism 5 comprises: an elastic clutch-type lock core 51 telescopically encapsulated in the first lock body 1, an inside telescopic end portion thereof abutting against the link 111 of the first handle 11; a connecting shaft 52 which both end portions are respectively linked to an outside telescopic end portion of the elastic clutch-type lock core 51 and a second handle 21. Preferably, the elastic clutch-type lock core 51 comprises: a first clutch piece 511 movably embedded in a main body 514 of the elastic clutch-type lock core, with one end portion thereof extending out of the elastic clutch-type lock core main body 514 and linked to a connecting shaft 52, an opposite end thereof being provided with a "V"-shaped slot 5111 (e.g., a triangular conical slot or a wedge-shaped slot), and, the slot consists of a first face 5113 and a second face 5115, the first face 5113 and the second face 5115 have an angle; a second clutch piece 512 movably embedded in the elastic clutch-type lock core main body 514, with one end portion thereof extending out of the elastic clutch-type lock core main body 514 and abutting against the link 111, an opposite end thereof being provided with a boss (e.g., a triangular conical boss or a wedge-shaped boss) mating with the "V"-shaped slot 5111; a second return spring 513 which is movably provided around the second clutch piece 512 and which both ends respectively abut against an internal chamber of the elastic clutch-type lock core main body 514 and the "Λ"-shaped boss 5121 of the second clutch piece. Furthermore, on one side of the "Λ"-shaped boss 5121 of the second clutch piece is provided a limiting pin 5122 extending out of the elastic clutch-type lock core main body 514 and engaging and disengaging the double lock limiting piece 42 to interfere the action of the elastic locking and controlling mechanism; on the other end of the "Λ"-shaped boss 5121 of the second clutch piece is provided a fixed pin 5123 extending out of the elastic clutch-type lock core main body 514 and combining the limiting pin 5122 to ensure a sliding direction of the second clutch piece 512. On both opposite sides of the elastic clutch-type lock core main body 514 are respectively provided an elongated guide groove 5141 for allowing the limiting pin 5122 and fixed pin 5123 to slide reciprocatingly.

Figure 5:
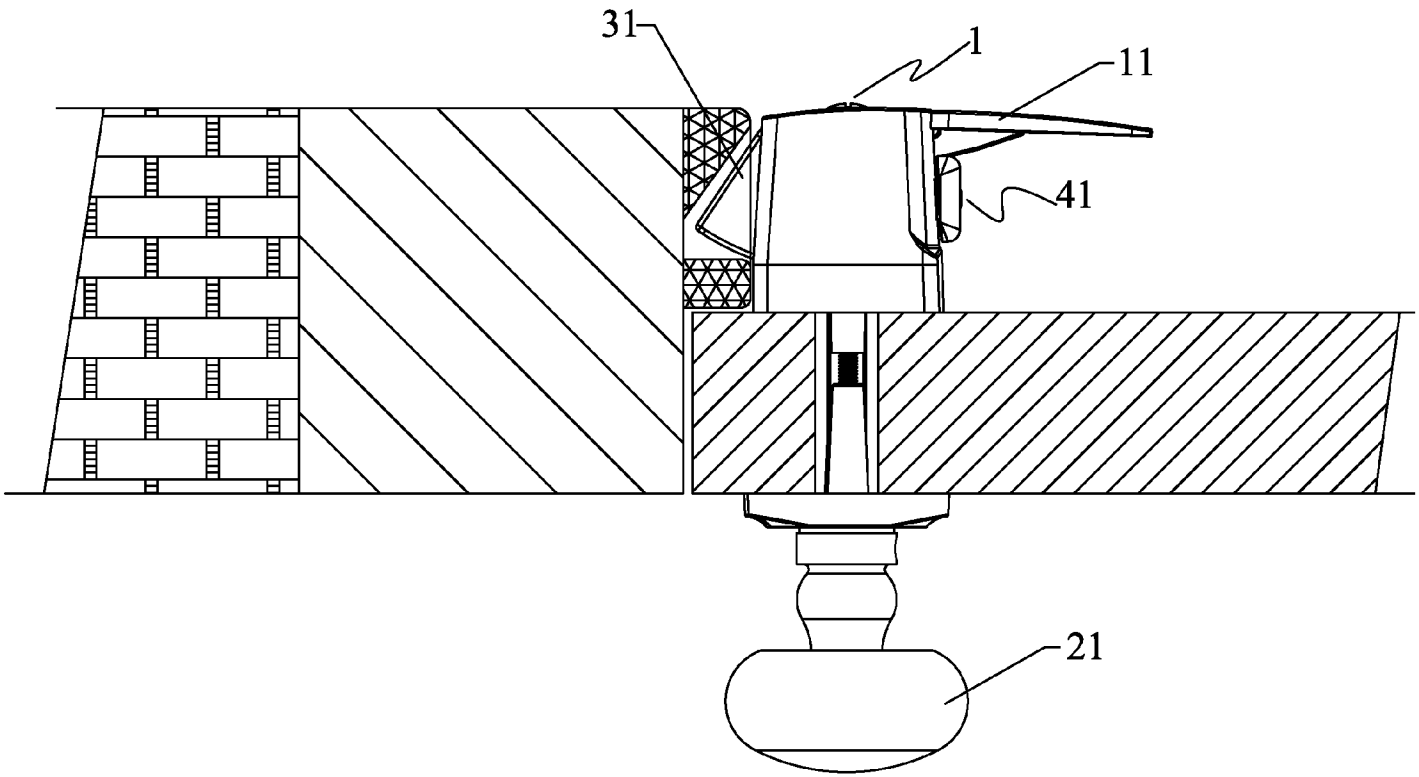
FIG. 5 is a view showing an in-use state of the present utility model.

As shown in FIGS. 2 and 5, the working principles of the present utility model are as follows:

1. closing a door or window: the latch 31, under the action of an elastic force of the first return spring 32, extends out of the first lock body 1 and engages with a lock slot on a door frame so that the door or window is in a closed state.

2. Opening the door or window: a) in order to open the door or window from inside, the first handle 1 is pressed and rotated, the link 111 of the first handle 11 applies a pressure to the latch 31 by leverage, and the latch 31, under pressure of the link 111, overcomes the elastic force of the first return spring 32 and rotates to retract into the first lock body 1, whereupon the door or window can be easily opened in the absence of the locking of the latch 31; b) when the door or window is to be opened from outside, the second handle 21 is rotated and brings the first clutch piece 511 to rotate synchronously via the connecting shaft 52. Since the second clutch piece 512 can only axially slide along the elongated guide groove 5141, during rotation of the first clutch piece 512, the "V"-shaped slot 5111 of the first clutch piece and the "Λ"-shaped boss 5121 of the second clutch piece get separated and staggered from each other due to clutching action, thereby urging the second clutch piece 512 to compress the second return spring 513 to slide inwardly along the elongated guide groove 5141 and extend out and push up the link 111 of the first handle 11, wherein the link 111, pushed up by the second clutch piece 512, applies a pressure to the latch 31, the latch 31, under pressure of the link 111, overcomes the elastic force of the first return spring 32 and rotates to retract into the first lock body 1, whereupon the door or window can be easily opened in the absence of the locking of the latch.

3. Double locking the door or window: when the door or window is in the closed state, the double lock control block 41 of the double lock switch 4 is pushed up, and the double lock limiting piece 42 moves upwardly along with the double lock control block 41, whereupon the double lock control block 41 abuts against and locks the first handle 11 outside the first lock body 1, the first handle 11 cannot be pressed downwardly to rotate, the double lock limiting piece 42, from inside the first lock body 1, abuts against and locks the limiting pin 5122 of the second clutch piece 512 of the elastic clutch-type lock core so that the second clutch piece 512 cannot clutch with the first clutch piece 511 and thereby slidingly extends out and pushes up the link 111 of the first handle 11, whereby the latch 31 cannot retract so that the door or window cannot be opened from inside and outside the door or window, thereby achieving the double lock anti-theft effect.

Embodiment 2

The implementation mode of Embodiment 2 is substantially identical with Embodiment 1 and differs from Embodiment 1 only in that an elastic press switch is provided at a position of the second lock body 2 in the middle portion of the second handle 21 and is linked to the connecting shaft 52 of the elastic locking and controlling mechanism 5. In operation, the elastic press switch is pressed. Since the elastic press switch has a certain inward indentation stroke, it can, via the connecting shaft 52, drive the first clutch piece 511 and the second clutch 512 to synchronously slide inwardly, wherein the second clutch piece 512 during sliding presses the link 111 of the first handle 11; the link 11, pressed by the second clutch piece 512, applies a pressure to the latch 31; the latch 31, under pressure of the link 111, overcomes the elastic force of the first return spring 32 and rotates to retract into the first lock body 1, thereby opening the door or window. The operations are also convenient and quick.

In this configuration, the unlocking can be effected by either rotating the second handle 21 or pressing the elastic press switch.

Embodiment 3

Embodiment 3 is substantially identical with Embodiment 2. The difference resides in cancellation of the first clutch piece and the second clutch piece, the connecting shaft is directly extended to press the link of the first handle, whereupon the unlocking can be effected only by pressing the elastic press switch.

The present utility model is not limited to the above embodiments. If various modifications or variations to the present utility model do not depart from the spirit and scope of the present utility model, and fall within the scope of claims of the present utility model and equivalent technologies, the present utility is intended to include such modifications or variations.

What is claimed is:

1. A side-hung door or window single latch lock, comprising:

a first lock body and a second lock body disposed on an inner side and an outer side of a door or window and sandwiching the door or window in between, the first lock body including a first handle and the second lock body including a second handle;

wherein the first lock body further comprises a latch assembly linked to the first handle and controlling opening and closing, and an elastic locking and controlling mechanism respectively linked to the first handle and the second handle to transmissively control the opening and closing of the latch assembly;

wherein the first lock body is provided with a double lock switch at one end of the first handle for locking the latch, the double lock switch comprising:

a double lock control block movably disposed outside of the first lock body;

a double lock limiting piece moveably disposed inside the first lock body and linked to the double lock control block; and a positioning elastic tab disposed outside the first lock body and provided around the double lock limiting piece;

wherein, when the door or window is in a closed state, the double lock control block of the double lock switch is pushed up, and the double lock limiting piece moves upwardly along with the double lock control block, whereupon the double lock control block abuts against and locks the first handle outside the first lock body, the first handle cannot be pressed downwardly to rotate;

wherein the double lock limiting piece, from inside of the first lock body, abuts against and locks the elastic locking and controlling mechanism, further wherein the elastic locking and controlling mechanism cannot exert pressure on the latch, whereby the latch cannot retract so that the door or window cannot be opened from inside and outside the door or window, thereby achieving a double lock anti-theft effect.

2. The side-hung door or window single latch lock according to claim 1, wherein the latch assembly comprises:

a latch which is rotatably and telescopically mounted in the first lock body and wherein a ramp end portion extends out of the first lock body and an opposite end portion is rotatably coupled to a latch mounting base in an internal cavity of the first lock body; and a first return spring disposed at a proximal end of a rotating and connecting position of the latch, with both ends thereof respectively abutting against the internal cavity of the first lock body and the latch to ensure the latch to tend to extend outwardly.

3. The side-hung door or window single latch lock according to claim 2, wherein the first handle is rotatably mounted on a side of the first lock body opposite to the latch, wherein a hand controlled end portion of the first handle extends out of the first lock body, an opposite end portion thereof is provided with a link, and the link is rotatably connected to a first handle mounting base of the internal cavity of the first lock body and linked to the latch at an outer end thereof.

4. The side-hung door or window single latch lock according to claim 1, wherein the double lock control block comprises a base and a lug locates on the center of the base, and the lug is perpendicular to the base, the positioning elastic tab is a rectangle tab and having a square hole.

5. The side-hung door or window single latch lock according to claim 4, wherein an arcuate protrusion is provided on each of both opposite ends of the positioning elastic tab, and a first arcuate recess and a second arcuate recess are provided at a position of the first lock body corresponding to the positioning elastic tab to mate with the arcuate protrusion;

wherein, when the double lock control block of the double lock switch is pushed up, the arcuate protrusion mate with the first arcute recess, the latch is locked and cannot retract; and when the double lock control block of the double lock switch is pushed down, the arcuate protrusion mate with the second arcute recess, the latch can retract.

6. The side-hung door or window single latch lock according to claim 1, wherein an elastic press switch is provided in the second handle of the second lock body and is linked to the elastic locking and controlling mechanism to control the opening and closing of the latch assembly.

7. The side-hung door or window single latch lock according to claim 1, wherein the elastic locking and controlling mechanism comprises an elastic clutch-type lock core including a first clutch piece and a second clutch piece converting a shaft rotation into an axial translation and cooperating in use.

8. The side-hung door or window single latch lock according to claim 7, wherein the elastic locking and controlling mechanism comprises:

the elastic clutch-type lock core telescopically encapsulated in the first lock body, an inside telescopic end portion thereof abutting against and cooperating with the link of the first handle; and a connecting shaft which both end portions are respectively linked to an outside telescopic end portion of the elastic clutch-type lock core and the second handle.

9. The side-hung door or window single latch lock according to claim 8, wherein the elastic clutch-type lock core comprises:

the first clutch piece movably embedded in a main body of the elastic clutch-type lock core, with one end portion thereof extending out of the elastic clutch-type lock core main body and linked to the connecting shaft, an opposite end thereof being provided with a slot, the slot consists of a first face and a second face, the first face and the second face have an angle;

the second clutch piece movably embedded in the elastic clutch-type lock core main body, with one end portion thereof extending out of the elastic clutch-type lock core main body and abutting against and cooperating with the link, an opposite end thereof being provided with a boss mating with the slot; and a second return spring which is movably provided around the second clutch piece and which both ends respectively abut against and cooperate with an internal chamber of the elastic clutch-type lock core main body and the boss of the second clutch piece.

10. The side-hung door or window single latch lock according to claim 9, wherein on one side of the boss of the second clutch piece is provided a limiting pin extending out of the elastic clutch-type lock core main body and engaging and disengaging the double lock limiting piece to interfere the action of the elastic locking and controlling mechanism; on the other end of the boss of the second clutch piece is provided a fixed pin extending out of the elastic clutch-type lock core main body and combining the limiting pin to ensure a sliding direction of the second clutch piece; and on both opposite sides of the elastic clutch-type lock core main body are respectively provided an elongated guide groove for allowing the limiting pin and fixed pin to slide reciprocatingly.

* * * * *